United States Patent [19]

Paidoussis

[11] 4,129,089

[45] Dec. 12, 1978

[54] MARINE PROPULSION APPARATUS

[76] Inventor: Michael P. Paidoussis, 241 Brookfield Ave., Mount Royal, Canada

[21] Appl. No.: 820,603

[22] Filed: Aug. 1, 1977

[30] Foreign Application Priority Data

Oct. 18, 1976 [CA] Canada ..... 263570

[51] Int. Cl.[2] ..... B63H 1/30

[52] U.S. Cl. ..... 115/28 A; 115/14

[58] Field of Search ..... 115/28 R, 28 A, 12 R, 115/14; 46/92, 95, 152; 416/79, 81, 82, 83

[56] References Cited

U.S. PATENT DOCUMENTS 621,719 3/1899 Shann ..... 115/28 A 3,321,923 5/1967 Smith ..... 115/12 R 3,561,156 2/1971 Tobias ..... 115/12 R

*Primary Examiner*—Trygve M. Blix

*Assistant Examiner*—D. W. Keen

*Attorney, Agent, or Firm*—George A. Seaby

[57] ABSTRACT

A marine propulsion apparatus including a flexible, elongated plate, with a flexible tube attached to each side of the plate, or a flexible plate through which fluid can be passed. In use, the plate is cantilevered to a boat. When water is passed through the tubes at a sufficiently high velocity, the tubes and plate undulate with a downstream propagating wave component, resembling the swimming motions of a slender fish. The result is a forward propulsion of the boat.

1 Claim, 2 Drawing Figures

MARINE PROPULSION APPARATUS

BACKGROUND OF THE INVENTION

1. Field of the Invention

This invention relates to a marine propulsion apparatus, and in particular to an ichthyic-type propulsion apparatus.

2. Description of the Prior Art

In general, the invention provides an apparatus for marine propulsion relying on the flexural, hydroelastic instability of a submerged, cantilevered plate. It is common knowledge that undulating plates can be used as a means of marine propulsion. Some so-called sculls rely on the undulating motion of a flexible oar pivoted to the stern of a boat for propelling the boat. However, the use of undulating motion and other propulsive methods have long been neglected, because of the outstanding simplicity and efficiency of a propeller. Nevertheless, in some cases, marine propulsion using undulating plates may have distinct advantages over the propeller, for example in deep water where sealing of rotatable propeller shafts is difficult, and in muddy and week-infested waters.

SUMMARY OF THE INVENTION

Accordingly, the present invention provides a marine propulsion apparatus, which, in its simplest form, includes a flexible plate one end of which can be connected to a boat, at least one flexible tube connected to the plate along substantially the entire length of the plate, and means for causing fluid to flow through the tube at a sufficiently high flow velocity to produce undulating motion of the plate for propelling the boat. By a flexible plate or tube is meant a plate or tube capable of flexing or undulating in a wave-like manner.

In a recent study (M. Botman, "Propulsion by Undulating Plates", J. Aircraft, Vol. 2, 1965, pages 456–462) it was found that a submerged cantilevered plate could be used to drive a catamaran, undulation of the plate being achieved by a motor through mechanical links. Botman concluded that his method is feasible, but of low efficiency.

The inventor has devised an alternative means of generating undulatory motion in a cantilevered plate, namely by fluid flow through tubes or pipes attached to the plate. Thus, the need for mechanical links has been eliminated, and better control over the waveform of the undulating plate can be achieved.

It has been found that, when the fluid flow velocity is sufficiently high in tubes attached to the cantilevered plate, an undulatory motion of the pipe ensues, the motion resembling the swimming motion of the slender fish. The motion is a result of flexural flutter of the tubes and the plate, the tubes becoming unstable at sufficiently high flow velocities.

DESCRIPTION OF THE PREFERRED EMBODIMENT

Figure 1:
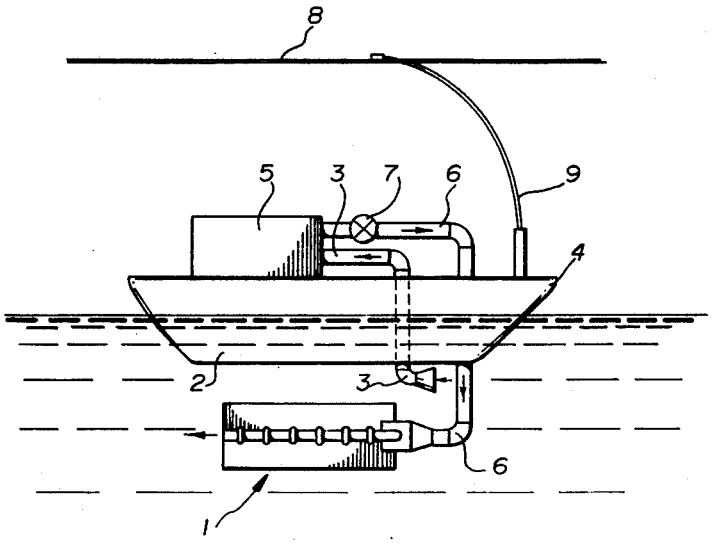
FIG. 1 is a schematic elevation view of an experimental marine vessel incorporating the apparatus of the present invention.

With reference to FIG. 1, the propulsion apparatus of the present invention, generally indicated at 1, is secured cantilever-fashion beneath a boat 2. The boat 2 is provided with an inlet duct 3, which is open toward the bow 4 of the boat for introducing water into a motor/-pump unit 5. Water is pumped from the unit 5 through an outlet duct 6, equipped with a valve 7, to the propulsion apparatus 1. In the present case, the motor in the unit 5 is an electric motor powered by an overhead line 8 and a trolley 9. It will be appreciated that the motor of the motor/pump unit could also be an internal combustion or diesel engine.

Figure 2:
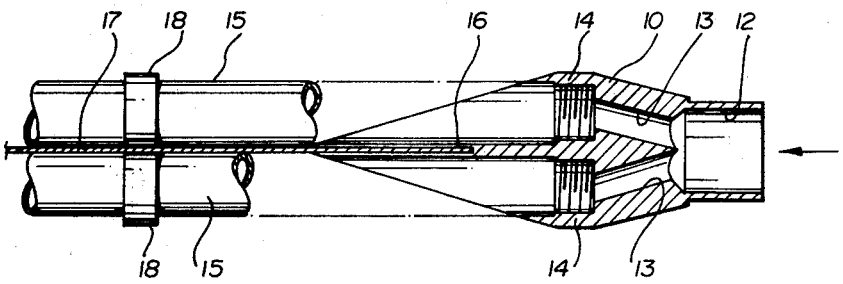
FIG. 2 is a partly sectioned plan view of the apparatus of FIG. 1 on a larger scale.

Referring now to FIG. 2, the apparatus 1 includes a coupler 10 connected to the discharge end of the outlet duct 6. The inlet end of the coupler 10 has a single large passage 12 in fluid communication with a pair of outlet passages 13, the walls of which are internally threaded at their trailing ends 14 for receiving a pair of flexible tubes 15. The trailing end of coupler 10 is provided with a notch 16 for one end of a thin, flexible plate 17. The plate 17 extends rearwardly from the coupler 10 between the tubes 15, which are secured to the plate 17 by C-brackets 18. The resulting structure is symmetrical with the tubes 15 opposite each other, so that the longitudinal axes of the plate 17 and tubes 15 are parallel, and lie in a plane perpendicular to the sides of the plate.

In operation, water introduced into the motor/pump unit 5 via the inlet duct 3 is pumped through the outlet duct 6 and the tubes 15. Of course, because of the change in momentum caused by the motor/pump unit 5, propulsion occurs even without undulation of the plate 17. However, it has been found that propulsion with undulatory motion of the plate is more efficient than without undulation. As the flow velocity in the tubes 15 is increased, the plate 17 is caused to undulate, with a rearward propagating wave increasing in amplitude in the downstream direction.

In order to confirm that propulsion with undulatory motion is more efficient than without such motion, a simple catamaran structure was constructed, using a ½ horsepower motor/pump unit 5 supported between the floats of the boat. The unit 5 was powered by an overhead line 8. The plate 17 was formed of brass, with a width of 6–15 cm, a length of 25–60 cm and a thickness of approximately 0.25 mm. The tubes 15 are TYGON (a registered trade mark), having a diameter of 0.632 cm and a wall thickness of 1.59 mm. The tubes 15 are clipped symmetrically to the sides of the plate 17, and the flow of water from the outlet duct 6 is divided equally between the tubes by the coupler 10. The experiments were conducted in a 91.5 cm × 91.5 cm × 15 m tank. Spoilers (not shown) on the rear of the catamaran controlled the forward speed of the craft.

Since propulsion occurs with or without undulation, for each set of experimental parameters, the forward speed was measured with and without undulation of the plate, the latter condition being achieved by adding a stiffener (not shown) to the upper edge of the plate. The stiffener was so shaped that the increase in drag was negligible.

The catamaran was held and the power turned on at a specific setting, and the catamaran was released. Allowing approximately 4 m for the catamaran to achieve a constant speed, the time for travel of the next 8.5 m was taken as a value U. Approximate measurements of phase velocity and frequency could be made by direct observation of the plate 17.

There was no difficulty in achieving propulsion, typically with a forward speed of $U \simeq 1$m/s. The undulation of the plate was a backward propagating wave with downstream or rearwardly increasing amplitude. Typically, the undulation frequency ($\omega$) was 15 rad/s and the wavelength was 0.6 l,l being the length of the plate, so that the reduced frequency was $\sigma = \omega l/2U \simeq 5$. For constant flow through the motor/pump unit 5, if U was allowed to increase by lowering the drag, the phase velocity became smaller than U, so that undulation impeded rather than aided propulsion. Moreover, if U increased sufficiently, the damping effect of external flow stabilized the plate 17 effectively neutralizing the destabilizing effect of fluid flow through the tubes 15. By increasing the flow velocity in the tubes 15, undulatory motion could be re-established. With the phase velocity of the undulating plate 17 higher than U, undulation did aid propulsion.

The experiments did establish that undulation with correct characteristics results in a higher speed. The most effective plate size was found to be 5 cm wide by 50 cm long, with pipes 43 cm long, which with undulation yielded speeds 30% higher than without undulation.

It will be appreciated that the apparatus of the present invention can readily be modified depending on the intended use. For example, the thin plate and attached flexible tubes can be in the form of a composite molded structure. Moreover, the material used in the tubes and plates can be any flexible plastic or metal. Of course, the metal should be non-corrosive.

By observing fish and from theoretical considerations, it is clear that the optimum shape of the plate/-tube combination is one which gives a smoothly downstream-propagating wave faster than the boat. In order to realize this to the maximum, it is possible to alter the mass distribution of the plate along its length, e.g. use a plate tapering rearwardly in terms of thickness, and change the rigidity and internal flow velocity of the tube along its length.

Such variations can be achieved by controlling the geometry and stiffness of the plate and tube.

I claim:

1. A marine propulsion apparatus comprising a flexible plate one end of which can be connected to a boat; a flexible tube connected to each side of the plate along substantially the entire length of the plate, the longitudinal axes of the tubes and plate being parallel and defining a plane perpendicular to the sides of the plate; pump means for causing water to flow through the tubes at a sufficiently high velocity to produce undulation of the plate and tube along substantially the entire length thereof for propelling the boat; and coupler means in fluid communication with said pump means and attached to the leading end of said tubes for simultaneously directing substantially equal quantities of water into each of said tubes.

* * * * *